US006830072B2

(12) United States Patent
Gautschi et al.

(10) Patent No.: US 6,830,072 B2
(45) Date of Patent: Dec. 14, 2004

(54) FITTING HOUSING

(75) Inventors: Christian Gautschi, Reinach (CH); Herbert Gloor, Unterkulm (CH)

(73) Assignee: KWC AG, Unterkulm (CH)

( * ) Notice: Subject to any disclaimer, the term of this patent is extended or adjusted under 35 U.S.C. 154(b) by 112 days.

(21) Appl. No.: 10/382,883

(22) Filed: Mar. 7, 2003

(65) Prior Publication Data

US 2003/0178071 A1 Sep. 25, 2003

(30) Foreign Application Priority Data

Mar. 13, 2002 (EP) ..... 02005717

(51) Int. Cl.[7] ..... F16K 11/074
(52) U.S. Cl. ..... 137/625.4
(58) Field of Search ..... 137/625.4

(56) References Cited

U.S. PATENT DOCUMENTS 4,685,487 A 8/1987 Derdack et al. ..... 137/315
6,058,972 A * 5/2000 Kahle et al. ..... 137/625.4
6,457,191 B2 * 10/2002 Brandebusemeyer et al. .... 137/625.4

* cited by examiner

*Primary Examiner*—John Fox
(74) *Attorney, Agent, or Firm*—Oliff & Berridge, PLC

(57) ABSTRACT

The invention relates to a fitting housing having an underside, a top side, lateral outer surfaces, a water outlet, a cutout for accommodating a mixing and/or metering cartridge, two supply channels, which lead from the underside to the cutout and through which, during use, the mixing and/or metering cartridge is fed hot and/or cold water, and at least one discharge channel, which leads from the cutout to the water outlet and through which, during use, water is led away from the mixing and/or metering cartridge. According to the invention, the fitting housing, at least over part of the height of the cutout, is in the shape of a polygon in cross section. The discharge channel has a first channel section which runs in the vertical direction in the region of one of the corners of the polygon. As a result of the shape according to the invention of the basic body, it is possible to reduce both the amount of material used and the dimensions of the basic body, while maintaining the same stability.

10 Claims, 4 Drawing Sheets

FITTING HOUSING

BACKGROUND OF THE INVENTION

1. Field of Invention

The invention relates to a fitting housing for supply and discharge channels. The present application claims priority to European Application No. 02 005 717.0 filed Mar. 13, 2002.

2. Description of Related Art

Fitting housings usually have to provide space for a mixing and/or metering cartridge and for the corresponding supply and discharge channels. For this purpose, the housing has a cutout for accommodating the cartridge as well as bores serving to channel water. The hot and cold water is usually supplied to the cartridge from the underside. The mixed water is likewise channeled away from the underside of the cartridge. From there, in accordance with the configuration of the fitting housing, and depending on the position of the water outlet, the discharge channel leads downward or upward past the cartridge or to the side. In the case of fittings for unpressurized boilers, a cold-water line leads to the metering cartridge. From the metering cartridge, in turn, a discharge channel, in this case for cold water, leads into the water outlet and a further channel, likewise for cold water, leads to the boiler. The hot water coming from the boiler is fed, through a further discharge channel, to the water outlet, where the hot water is mixed with the cold water coming from the metering cartridge.

In the case of compact fittings of low overall height, the water outlet is usually level with the cutout for the mixing and/or metering cartridge. The discharge channel thus has to be led upward, at least in part, through the sidewall of the fitting housing. This requires a certain minimal wall thickness of from 0.8 to 1.5 mm level with the cutout. With the exception of the water outlet, known fitting housings are usually at least more or less rotationally symmetrical in relation to their longitudinal axis, i.e., they have, at least more or less, a circular cross section. The wall thickness, over the height of the mount, is constant in a cross-sectional plane, and dimensioned at least such that the discharge channel, with a certain minimum diameter, is accommodated therein, it being necessary to ensure the stability of the housing. This means that it is not possible to reduce the dimensions of the fitting housing further in the case of a predetermined cartridge size. There is often a need, however, for fittings with even smaller dimensions, which additionally have to satisfy aesthetic requirements.

The object of the invention is thus to provide a fitting housing which can be produced in a compact manner, with low material outlay, and, in the process, satisfies both the stability-related requirements and aesthetic requirements.

The object is achieved by a fitting housing having an underside, a top side, lateral outer surfaces, a water outlet, a cutout, two channels and a discharge channel. Advantageous developments can be gathered from the dependent claims, the description and the drawings.

SUMMARY OF THE INVENTION

According to the invention, the fitting housing is in the shape of a polygon, rather than a circle as has been the case hitherto, in the horizontal direction in cross section. This shape is provided at least over part of the height of the cutout, to be precise in the part in which the discharge channel runs alongside the cutout in the sidewall of the fitting. In the region above or beneath this, it is possible to select a different cross-sectional shape with a reduced cross-sectional surface area. At least a first channel section of the discharge channel runs in a vertical direction in the region of one of the corners of the polygon. A rectangular, in particular square, cross section is preferred. It is also possible for the corners to be rounded. This makes it possible for the cutout, which is usually circular in cross section, to be enclosed by material of the fitting housing such that the sidewall in the region of the corners, is sufficiently thick for a bore which forms the first channel section, and the fitting housing is as compact as possible. It is likewise possible to select a triangular, pentagonal or hexagonal basic shape.

Over the height of the cutout and of the first channel section, the wall thickness is preferably at least 2 mm in the region of the narrowest location, i.e., in the region of the shortest distance between the interior surface of the cutout and the outer surface of the fitting housing, and preferably at least 11mm in the region of the corners. A first channel section with a typical diameter of 6 mm can thus be reliably arranged in the region of a corner without the stability of the fitting housing being impaired as a result.

The water outlet is preferably arranged on that lateral outer surface of the fitting housing which has the first channel section located at one corner. The first channel section then leads at least up to the level of the water outlet. A second channel section is then used to produce a preferably horizontally running connection to the water outlet. By arranging the water outlet level with the mixing or metering cartridge, it is possible to provide a fitting of reduced overall height.

If the hot water is produced by a boiler, then an unpressurized second discharge channel is preferably located in the region of a further corner of the fitting housing, this channel serving to channel hot water into the outlet.

BRIEF DESCRIPTION OF THE DRAWINGS

Examples of the invention are described herein below and illustrated in the drawings, in which, purely schematically.

DETAILED DESCRIPTION OF EXEMPLARY EMBODIMENTS

Figure 1C:
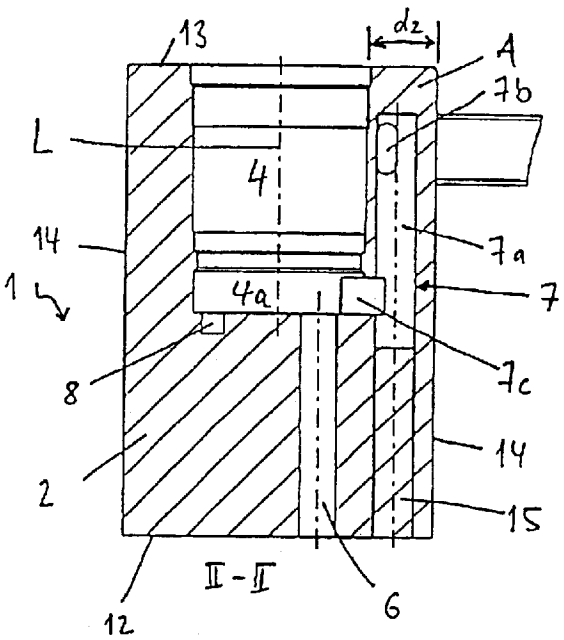
FIGS. 1*a–c* show different views of a first embodiment of the invention.
Figure 1B:
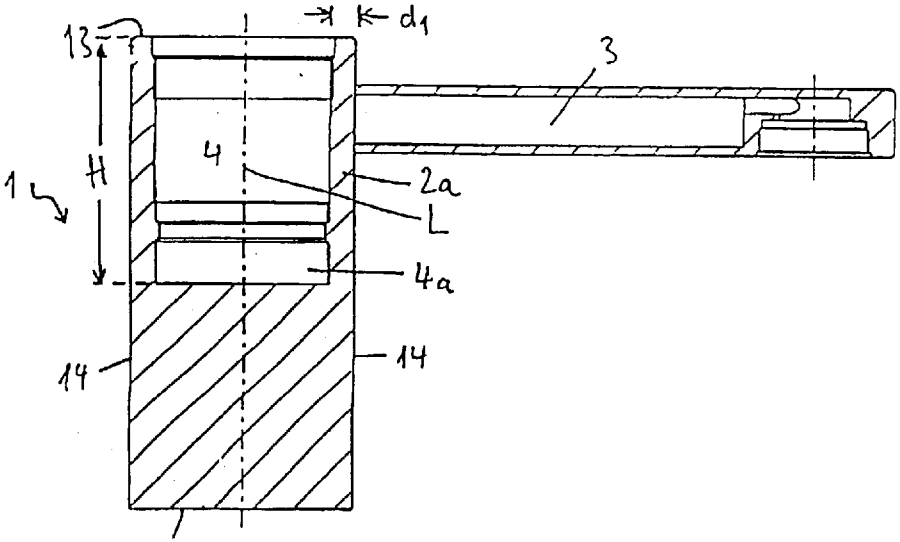
Figure 1A:
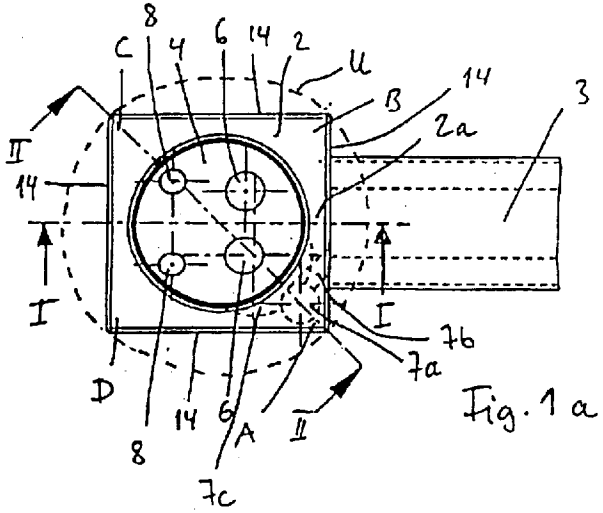
Figure 2C:
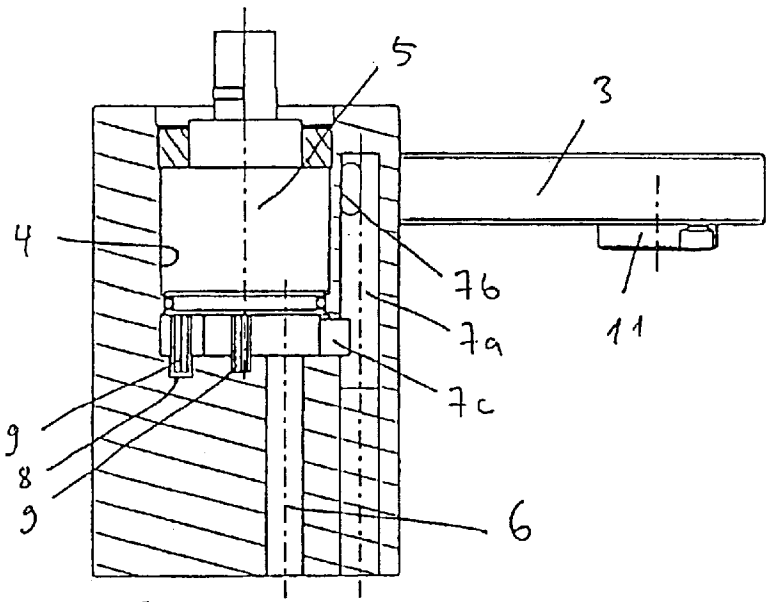
FIGS. 2*a–c* show views of a fitting with a fitting housing according to FIGS. 1*a–c;*
Figure 2B:
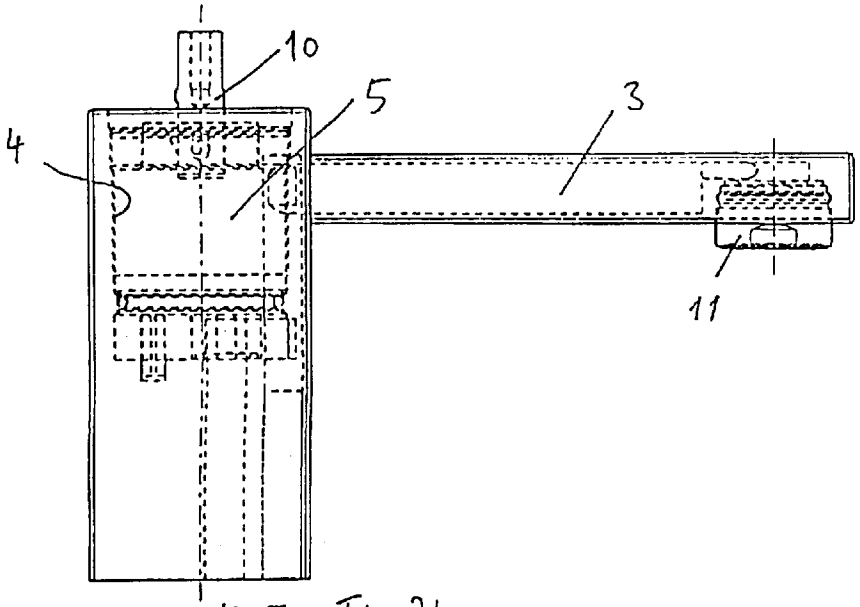
Figure 2A:
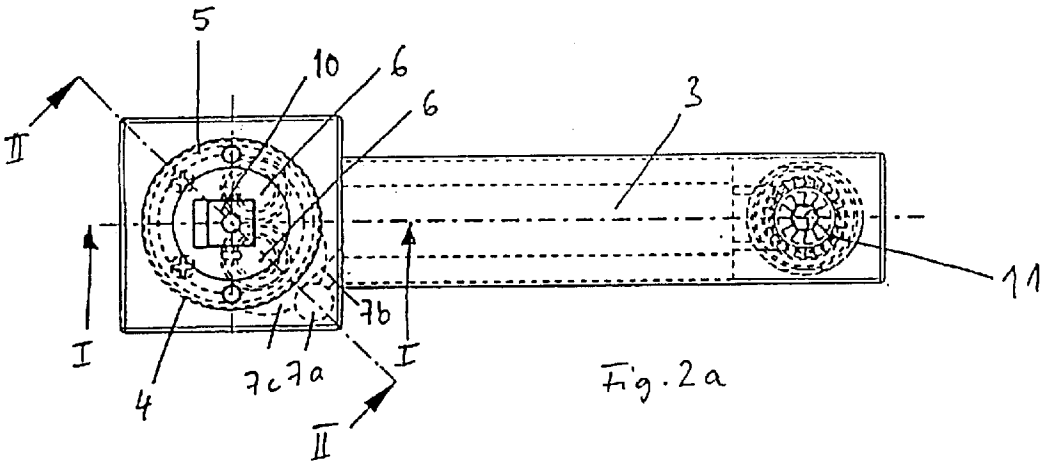

FIG. 1*a* shows a plan view of a fitting housing 1 according to the invention with a basic body 2 which is in the shape of a cuboid with an essentially square cross section. FIG. 1*b* shows a section along line I—I, and FIG. 1*c* shows a section along line II—II. In the region of its top end, the basic body 2 has a centrally arranged cutout 4 for accommodating a mixing and/or metering cartridge 5. The installed state is illustrated in FIGS. 2*a–c*. The cutout 4 is circular in horizontal section, has the height H and is more or less cylindrical, its longitudinal axis coinciding with the longitudinal axis L of the basic body 2. In its base region 4*a*, the cutout has one or more accommodating hollows 8 which serve for accommodating orientation pins arranged at the bottom end of the cartridge 5. The cartridge 5 may also be oriented in the housing by means of suitable milled recesses.

Two, or possibly even more, supply channels 6 for hot and/or cold water lead from the underside 12 of the basic body 2 to the bottom end 4*a* of the cutout. In the projected view from above, these channels run in a circular base surface of the cutout 4.

A discharge channel 7 for mixed water leads from the base region 4*a* of the cutout 4 to a water outlet 3, which is arranged laterally on the basic body 2. The discharge channel 7 has a first channel section 7*a*, which runs in the vertical direction parallel to the lateral outer surface 14 and to the longitudinal axis L. In the projected view from above, the first channel section is arranged in the region of one of the corners A, B, C, D, in this case corner A. The wall thickness d2 of the sidewall 2*a* is at a maximum in this region. The wall thickness d1 is considerably smaller in the region of the center of the lateral outer surfaces 14.

A second channel section 7*b* branches off in the horizontal direction at the top end of the first channel section 7*a*. Said second channel section leads into the water outlet 3. A third channel section 7*c* connects the bottom region 4*a* of the cutout 4 to the first channel section 7*a*. The third channel section 7*c* is sickle-shaped in plan view and may also serve as a mixing chamber.

FIG. 1*a*, furthermore, depicts the outline U of a conventional fitting housing of circular cross section and with the same wall thickness d2 in the region of the first channel section 7*a*. It can be seen that, as a result of the shape according to the invention of the basic body 2, it is possible to reduce both the amount of material used and the dimensions of the basic body, while maintaining the same stability.

The first channel section 7*a* may be realized by a blind bore which extends from the underside 12 and runs in the vertical direction to the top side 13. The bottom region of this bore is closed by a closure pin 15.

FIGS. 2*a–c* show the fitting housing 1 according to FIGS. 1*a–c* with a mixing and/or metering cartridge 5 installed, the latter having been inserted into the cutout 4. At its top end, said cartridge has an extension 10 for a mixing lever. An outlet insert 11, furthermore, is inserted into the water outlet 3.

Figure 3C:
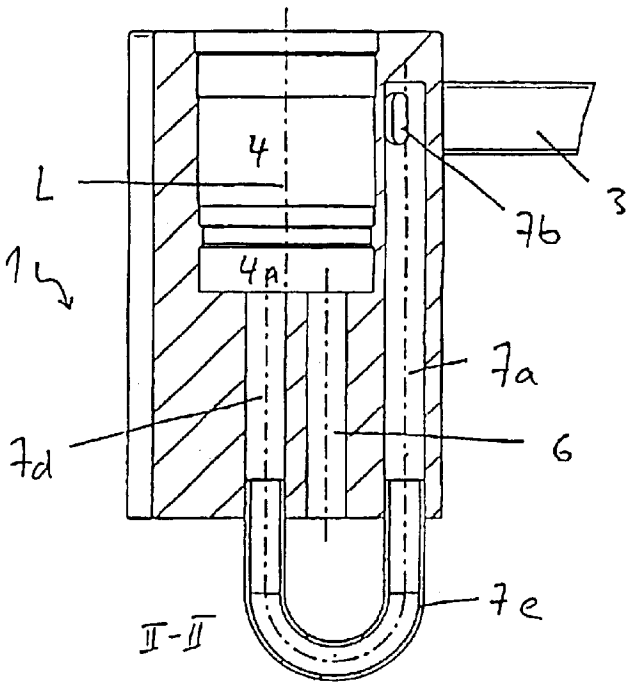
FIGS. 3*a–c* show different views of a further example of a fitting housing according to the invention.
Figure 3B:
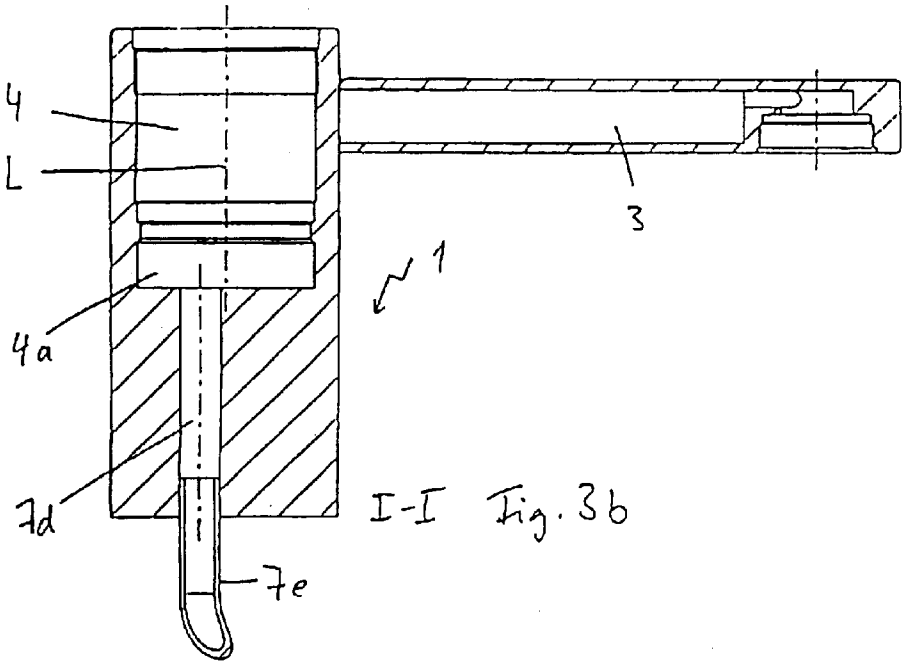
Figure 3A:
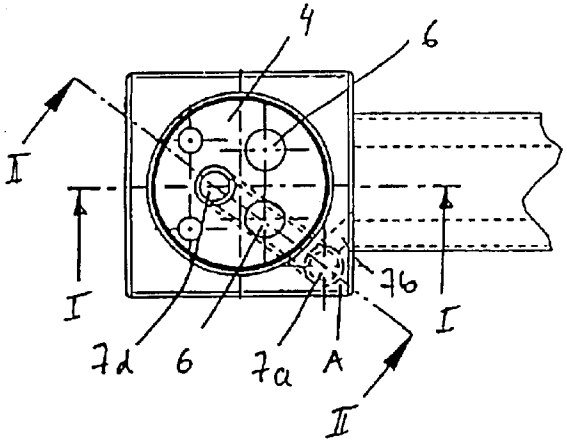

FIGS. 3*a–c* show a further, slightly modified example of a fitting housing 1 according to the invention which differs from the already described example merely by way of the shape of the discharge channel 7. It is thus only this difference which will be discussed herein below. In this case, the discharge channel 7 comprises a first channel section 7*a*, which runs vertically upwards from the underside 12 in the region of the corner A. A second horizontally running channel section 7*b* constitutes the transverse connection to the water outlet. A further channel section 7*d* runs from the underside 12 to the base region 4*a* of the cutout 4. It serves for discharging mixed water from the mixing and/or metering cartridge. The water is first of all discharged downward and then channeled into the first channel section 7*a* via a U-shaped connecting element 7*e*. Instead of a fixed connecting element 7*e*, it is also possible for a moveable hose to be connected to the bottom end of the further channel section 7*d* and led through the first and second channel sections 7*a*, 7*b* and the water outlet 3. In this case, the top end of the first channel section 7*a* and the second channel section 7*b* have to be adapted to the shape of the hose.

Figure 4C:
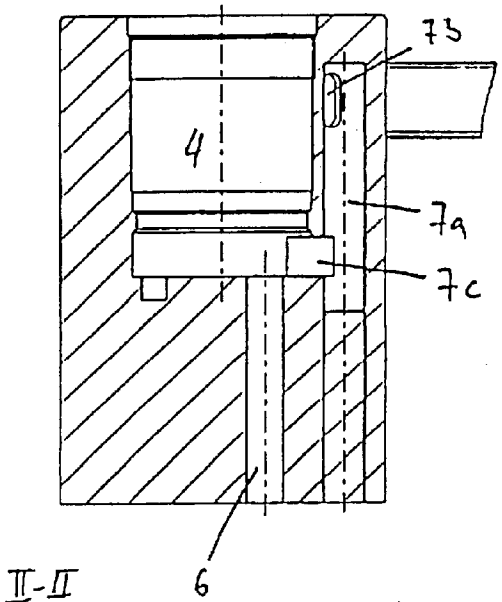
FIGS. 4*a–c* show a fitting housing according to the invention for an unpressurized boiler.
Figure 4B:
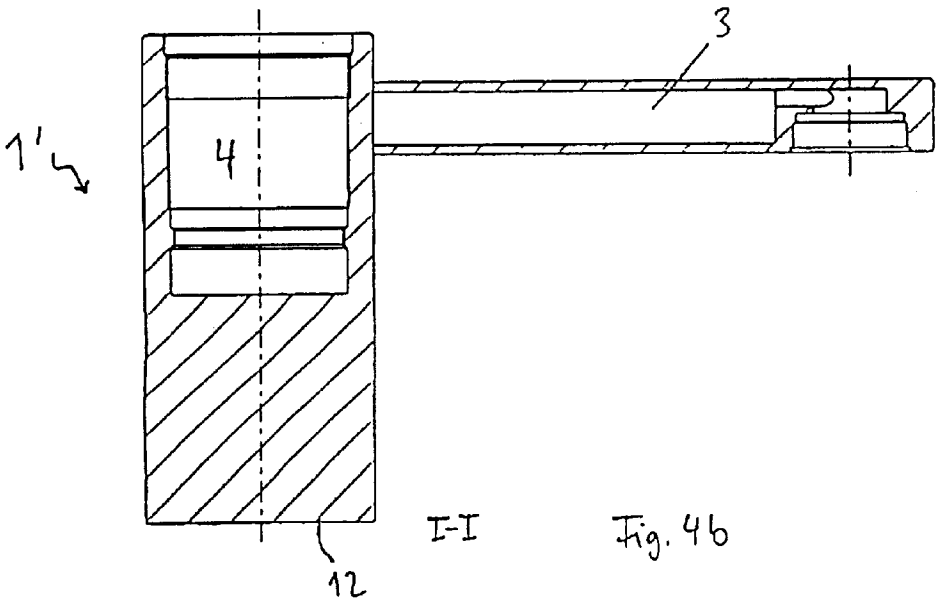
Figure 4A:
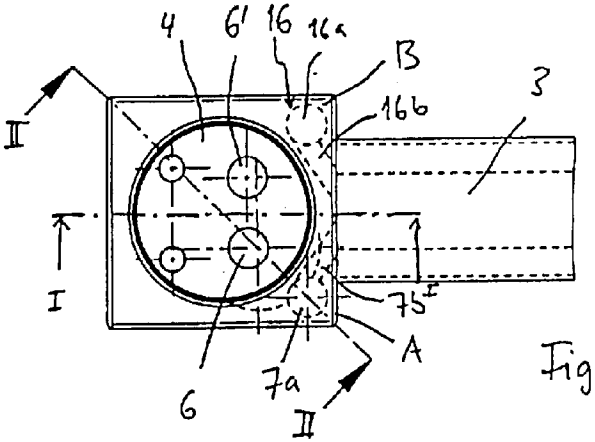

FIGS. 4*a–c* show a fitting housing 1' for an unpressurized boiler. In contrast to the fitting housings which have already been described, just one supply channel 6, which serves for supplying the cartridge 5 with cold water, in this case leads to the cutout 4. A further channel 6' channels cold water from the cartridge 5 to the boiler (not illustrated here). The quantity of cold water channeled away is set in a manner known per se. The discharge channel 7, which is designed as in FIGS. 1-3, in this case channels only cold water into the outlet arm 3. A further channel 16 runs from the underside 12 of the fitting housing 1' to the outlet arm 3 to channel hot water coming from the boiler. This hot water is mixed in the outlet arm 3 with the cold water channeled in the discharge channel 7. The further channel 16 has a first channel section 16*a*, which runs vertically in the corner B and runs from the underside 12 up to the level of the outlet arm 3. The connection to the outlet arm 3 is produced by an essentially horizontally running second channel section 16*b*. Means which are known per se, that are not illustrated here, ensure that it is not possible for any positive pressure to build up in the further channel 16 or in the boiler.

While the invention has been described with reference to exemplary embodiments thereof, it is to be understood that the invention is not limited to the disclosed embodiments or constructions. To the contrary, the invention is intended to cover various modifications and equivalent arrangements. In addition, while the various elements of the embodiments are shown in various combinations and configurations, which are exemplary, other combinations and configurations, including more, less or a single element, are also within the spirit and scope of the invention.

What is claimed is:

1. A fitting housing comprising:

an underside;

a top side;

a plurality of lateral outer surfaces;

a water outlet;

a cutout for accommodating a mixing and metering cartridge;

at least two channels, which lead from the underside to the cutout and through which, during use, water is channeled to and from the mixing and metering cartridge; and at least one discharge channel, which leads from the cutout to the water outlet and through which, during use, water is led away from the mixing and metering cartridge, the discharge channel being arranged, at least in part, in a first region between the cutout and the lateral outer surface, wherein the fitting housing, at least over part of the height of the cutout, is in the shape of a polygon in cross section, and the discharge channel has a first channel section which runs in the vertical direction in a second region of one of the corners of the polygon.

2. The fitting housing according to claim 1, wherein the polygon is a rectangle.

3. The fitting housing according to claim 2, wherein the fitting housing is cylindrical with a rectangular cross section.

4. The fitting housing according to claim 3, wherein the first channel section runs parallel to the longitudinal axis of the fitting housing and the cutout is centered about the longitudinal axis.

5. The fitting housing according to claim 1, which comprises a second channel section which runs essentially horizontally from the first channel section to the water outlet.

6. The fitting housing according to claim 1, wherein the discharge channel further includes:

a further channel section, which runs from the cutout to the underside, a first channel section, which runs from the underside up to a level of the water outlet, and a second channel section, which runs horizontally to the water outlet, wherein the first and the further channel sections are connectable to a connecting tube on the underside.

7. The fitting housing according to claim 1, wherein a wall thickness in the first region of the cutout at the narrowest locations is at least 2 mm and at least 11 mm in the second region of the corners.

8. The fitting housing according to claim 1, which comprises a further channel for channeling hot water from a boiler to the water outlet, the further channel having a first channel section which runs in the vertical direction in a third region of another corner of the polygon.

9. The fitting housing according to claim 1, wherein the polygon is a square.

10. The fitting housing according to claim 2, wherein the fitting housing is cylindrical with a square cross section.

* * * * *